US005937618A

United States Patent [19]

Chandler

[11] Patent Number: 5,937,618

[45] Date of Patent: Aug. 17, 1999

[54] VAPOR PHASE CORROSION INHIBITOR PACKAGE UTILIZING PLASTIC PACKAGING ENVELOPES

[75] Inventor: Christophe Chandler, Woodbury, Minn.

[73] Assignee: Cortec Corporation, St.Paul, Minn.

[21] Appl. No.: 09/127,696

[22] Filed: Feb. 6, 1998

Related U.S. Application Data

[62] Division of application No. 08/617,295, Mar. 18, 1996, Pat. No. 5,715,945.

[51] Int. Cl.[6] ..... B65B 11/52; B65B 55/00

[52] U.S. Cl. ..... 53/427; 53/428; 53/478

[58] Field of Search ..... 53/401, 402, 428, 53/427, 509, 478, 485

[56] References Cited

U.S. PATENT DOCUMENTS

| | | | |
|---|---|---|---|
| 3,202,278 | 8/1965 | Taylor . | |
| 3,326,372 | 6/1967 | Fineman et al. . | |
| 3,433,694 | 3/1969 | Nuttall . | |
| 3,784,004 | 1/1974 | Meyer . | |
| 4,374,174 | 2/1983 | Stricklin et al. | 53/428 |
| 4,815,602 | 3/1989 | Schirmer . | |
| 5,139,700 | 8/1992 | Miksic et al. . | |
| 5,209,869 | 5/1993 | Miksic et al. . | |
| 5,344,589 | 9/1994 | Miksic et al. . | |
| 5,426,916 | 6/1995 | Grigsby et al. | 53/431 |
| 5,715,945 | 2/1998 | Chandler . | |
| 5,752,358 | 5/1998 | Chadwick | 53/402 |

*Primary Examiner*—Linda Johnson
*Attorney, Agent, or Firm*—Haugen Law Firm PLLP

[57] ABSTRACT

A package containing a vapor phase corrosion inhibitor for use in forming film packaging envelopes. The package, and the method of forming the package include the selection of a suitable substrate board, and the application of a thermally activated adhesive film containing a quantity of vapor phase corrosion inhibitor onto the surface of the board. The films are thermal forming resins, such as a copolymer of ethylene and a vinyl monomer having an acid group thereon, and with the film resin also being blended with a vapor phase corrosion inhibitor. The vapor phase corrosion inhibitors used in the adhesive and in the film are selected from the group consisting of blends of alkali metal molybdates, alkali metal nitrites, triazoles, and amine salts. In forming the package, the films are initially heated or formed separately, and thereafter moved into contact with the substrate, this being undertaken with the peripheral areas of the film thereby becoming bonded to the substrate.

2 Claims, 3 Drawing Sheets

10
18
15
17
16
12
13
13
13
13
11

10
18
15
17
13
13
16
13
13
12
11

10
18
15
17
13
13
17
16
13
13
12
11
20

10
18
15
17
16
13
13
17
13
13
12
11

VAPOR PHASE CORROSION INHIBITOR PACKAGE UTILIZING PLASTIC PACKAGING ENVELOPES

This application is a divisional of Ser. No. 08/617,295, filed Mar. 18, 1996, now U.S. Pat. No. 5,715,945.

BACKGROUND OF THE INVENTION

The present invention relates generally to an improved method and apparatus for protecting surfaces of a metallic object against corrosion while sealed within a plastic packaging envelope, and more particularly to such a method, apparatus, and package employing a vapor phase corrosion inhibitor (VCI) in the adhesive and film utilized in forming the packaging including the envelope so as to insure dispersal of the inhibitor throughout the package during its formation and thereafter. The method and apparatus of the present invention has been found effective in protecting the surfaces of metallic objects enclosed within plastic packaging envelopes, while at the same time, posing no threat to either the environment or the ultimate user of the object being protected. The present invention employs a vapor phase corrosion inhibitor in the packaging film and a substrate coated with a thermally activated adhesive (containing a vapor corrosion inhibitor) so as to complete the formation of the protective enclosure while simultaneously dispersing the corrosion inhibitor within the interior of the envelope. In this manner, a consistent and uniform film of inhibitor is made available for the long term protection of the metallic object.

Plastic packaging processes are widely used in the packaging of articles, particularly for display in vending. In particular, plastic packaging is widely utilized in packaging for display at retail, either on racks, in bins, or the like. Typically, skin packaging operations employ a substrate board of low density and high porosity and having an adhesive coating thereon, upon which the product is placed. Thereafter, a film is bonded to form the package, with the board and film enveloping and capturing the product therewithin. In these operations and in forming the package, the film is typically heated to a formable temperature, and thereafter placed in contact with the adhesive film on the surface of the substrate, and with a vacuum being utilized to draw the film tightly around the product secured therewithin.

Blister packs including blister shells formed from polyvinylchloride (PVC) or other suitable film forming resins are also widely used with the preformed blister being bonded to a heat activated resin coated on a board substrate to form the completed enclosure.

While conventional skin and blister packaging applications provide protection for the article for mechanical purposes prior to sale to the ultimate consumer, these types of packaging may require additional protection to inhibit potential damage from humid and/or corrosive environments. For example, the high porosity substrate required for the vacuum draw operation permits the subsequent introduction into the package envelope of water vapor and other potentially harmful gaseous components. Included in these gaseous components are various sulfides such as hydrogen sulfide and certain air-borne mercaptans, all in addition to the universally present water vapor. These corrosive components may be introduced into the envelope during extended shipping and storage times typically encountered between the completion of the packaging operation and the final transfer of the product to the ultimate consumer. These periods normally include time involved in final display for retail purposes. Blister packaging operations expose the packaged articles to the same corrosive components as skin packaging applications, with the additional possible exposure to gases created in any breakdown of the PVC components of the envelope.

Newly manufactured metallic articles frequently have fresh metal surfaces which are highly susceptible to corrosion, and as indicated above, corrosion may occur as a result of exposure to corrosive gases typically found in the ambience as well as those which may develop from the PVC envelope. Humid environments are almost universally encountered with varying degrees of severity. Fluctuations in temperature can cause condensation of the trapped water vapor and ultimate deposition of the condensate on metallic surfaces. Additionally, the presence of even minute quantities of corrosive gases such as hydrogen sulfide and various mercaptans may cause surface corrosion and ultimate cosmetic deterioration and in certain instances, mechanical deterioration of the article. The polyvinylchloride film utilized in most blister packaging operations is a possible source of chloride which is especially corrosive to many metallic articles. In certain aggravated circumstances, serious mechanical as well as cosmetic deterioration may occur so as to render the product as well as the package worthless. As a result, therefore, a need has developed for providing added protection for metallic articles contained within packaging, particularly skin or blister packaging.

While various packages may be prepared with vapor phase corrosion inhibitors being applied to substrate boards alone, it has been found that the present invention provides significantly greater protection and conserves resources by careful and practical utilization of the inhibitor. Since plastic film packaging may be employed for a wide variety of applications, and since only a portion of these applications require corrosion inhibitors, the present invention provides a specific means for creating a continuous in-situ source for the compound forming the vapor phase corrosion inhibitor, and further provides a desirable mechanism for dispersing and retaining the inhibitor within the confines of the envelope as it is being formed and for a substantial period of time thereafter. As such, greater long-term protection is provided with uniform and practical dispersal of the corrosion inhibitor being achieved.

SUMMARY OF THE INVENTION

Briefly, in accordance with the present invention, a method and apparatus is provided for enclosing and protecting a metallic object against corrosion while sealed within a skin or blister packaging envelope utilizing vapor phase corrosion inhibitors. The present invention includes the step of preparing a substrate by applying a film of thermally activated adhesive onto the surface of the substrate. The thermally activated adhesive as applied is in admixture with a vapor phase corrosion inhibitor, with the inhibitor preferably being selected from a mixture of compounds including alkali metal of molybdate salts and nitrites, triazoles and amine salts.

The resins utilized in forming skin film and blisters for blister pack operations are blended with a vapor phase corrosion inhibitor to create an additional source of the inhibitor. A typical skin film is a thermal-forming cationic ionomer resin film comprising a copolymer of ethylene and a vinyl monomer with an acid group thereon or a polyethylene film that has been suitably activated and treated to adhere to the substrate adhesive. The resin from which the skin film is prepared is blended, prior to extrusion, with a quantity of vapor phase corrosion inhibitor powder. These blended resins adhere well to the thermally activated adhesive containing the corrosion inhibitor. Thermal-forming cationic ionomer film-forming resins comprising a copolymer of ethylene and a vinyl monomer having an acid group are commercially available (as are polyethylene films). Blisters used for blister packs are typically fabricated from polyvinylchloride (PVC) resin, although cellulose acetate butyrate (CAB) resins are sometimes utilized. The thermally activated adhesives used with such resin films are typically water emulsions such as ethylene vinyl acetate, and are likewise commercially available.

In operations consistent with the features of the present invention, an example of one of the packages of the present invention is set forth below utilizing the steps set forth hereinafter. Initially, the article to be packaged, encapsulated, or otherwise captured in a skin film package, for example, is positioned on the substrate, and the thermal-forming skin resin film containing vapor phase corrosion inhibitor is positioned in superimposed relationship to the substrate-article combination. While in this superimposed position, the blended skin film is heated to its formable temperature and while at this temperature, the film is dropped until it comes into contact with the article being packaged and the surface of the substrate. Predetermined areas of the skin film are in face-to-face contact with the thermally activated adhesive layer, with the package entirely covering at least those portions of the article being packaged and protected. In the initial phase of the process for forming the package of the present invention, a precursory enclosure is formed about the object being packaged, and immediately upon positioning of the film and contacting the surface of the substrate, a vacuum is applied to the undersurface of the porous substrate to draw the skin film tightly about the periphery of the object being packaged. At the same time, the substrate adhesive becomes activated and bonds and seals the film to the surface of the substrate. In the course of the process, and as the heated components approach the surface of the adhesive film, a quantity of vapor corrosion inhibitor material present in admixture with the adhesive and with the film is released and becomes dispersed within the precursory enclosure. In this fashion, the object being packaged and protected is captured within the package, with the surface of the object being covered or coated with a thin film or layer of corrosion inhibitor. It will be noted that the elevated temperatures to which the thermally activated adhesive layer is subjected is helpful in increasing sublimation of the vapor phase corrosion inhibitor from the film and from the adhesive mixture.

Another example of the invention is a typical blister package formed from adhering molded polyvinylchloride or other formable resins containing vapor corrosion inhibitors to a heat activated adhesive coated on a substrate wherein the heat activated adhesive contains vapor corrosion inhibitors. One distinction between skin film packaging and blister packaging is that in blister packaging, the blister component is a three-dimensional open-bottom receptacle and is prepared and placed in inverted position in a mold or other receptacle, and the article to be protected is dropped or otherwise placed into the blister.

Therefore it is a primary object of the present invention to provide an improved package and method for undertaking film packaging wherein the protective enclosure surrounding the object, such as a metallic object, is provided with an atmosphere containing a vapor phase corrosion inhibitor, with the inhibitor being available as a result of dispersal within the enclosure forming the envelope of the package.

It is yet a further object of the present invention to provide an improved technique for the forming of enclosures about articles in skin or blister packaging operations, wherein the film and the thermally activated adhesive employed to bond the film to the substrate each contain, in admixture, a vapor phase corrosion inhibitor for protecting the packaged object.

Other and further objects of the present invention will become apparent to those skilled in the art upon a study of the following specification, appended claims, and accompanying drawings.

IN THE DRAWINGS

Figure 5:
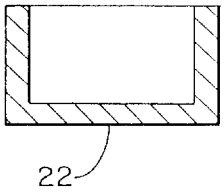
Figure 6:
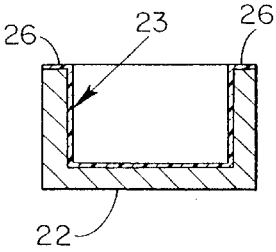
Figure 7:
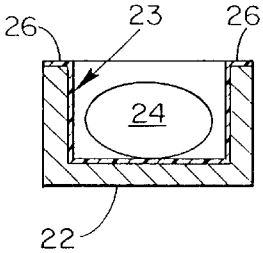
Figure 8:
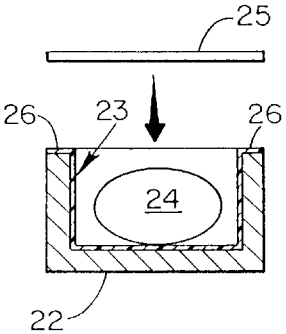
Figure 9:
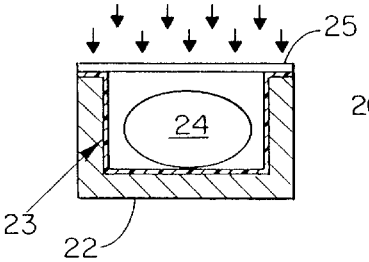
Figure 10:
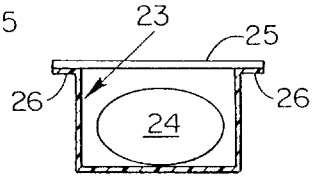

FIGS. 5 through 10 illustrate steps of a process utilizing the features of the present invention in a blister packaging operation and wherein FIGS. 5 through 9 of these figures are each vertical sectional views of a nest mold in which the blister packaging operation is undertaken, with FIG. 5 illustrating the nest mold; with FIG. 6 illustrating the mold to which the blister has been inserted; with FIG. 7 illsutrating the arrangement after a metal part to be packaged has been deposited into the blister; with FIG. 8 illustrating the configuration with the substrate board being advanced into contact with the blister flanges; and with FIG. 9 demonstrating schematically the application of heat to the substrate board; and FIG. 10 illustrates the arrangement of components in the completed blister packaging operation.

DESCRIPTION OF THE PREFERRED EMBODIMENT

In accordance with the preferred embodiments of the present invention, skin and blister packaging operations utilizing the features of the present invention are described below.

Preparation of the Substrate Boards

Initially, a generally porous substrate board is selected and prepared for the packaging operation by undergoing a printing operation wherein a printed indicia, specific to the application, is applied to at least one surface of the substrate. Substrate boards for skin packaging operations are fabricated of a low density, high porosity, fibrous material and are commercially available. These products provide high strength as well as a smooth surface to receive printed indicia. This surface is, of course, designed for receiving a layer or film of adhesive thereon, with the adhesive typically being applied directly over the printing.

The adhesive is a thermally-activated adhesive, with a variety of resins being widely commercially available. Typical thermally-activated adhesives utilized in film packaging applications consist of formulations of water emulsions of ethylene vinyl acetate. Such adhesives are commercially available and generally have an activation temperature range of between about 110 degrees C and 130 degrees C. Such adhesives are compatible with vapor phase corrosion inhibitors useful in connection with the present invention.

In selecting the vapor phase corrosion inhibitor, those found most useful in connection with the present invention consist essentially of alkali molybdates, alkali nitrites, triazoles, and amine salts, and mixtures thereof. Reference is made to U. S. Pat. Nos. 5,139,700; 5,209,869; and 5,344,589, each assigned to the assignee of the present invention, for a description of a variety of vapor phase corrosion inhibitors.

The Preparation of the Skin Film

A thermal forming resin film comprising a copolymer of ethylene and a vinyl monomer with an acid thereon is selected. One such material which is commercially available is under the trade designation "Surlyn 1601-2" available from E.I. DuPont de Nemours Corp. of Wilmington, Del. A skin film preparation is prepared pursuant to the formulation described in Example I hereinbelow.

EXAMPLE I

A skin film formulation is prepared as follows:

Thermal film forming resin 85 pounds.

This resin is available from E. I. DuPont de Nemours Corp. of Wilmington, Delaware under the trade designation "Surlyn 1601-2".

Fifteen pounds of a corrosion inhibitor formulation was prepared as follows:

| Component | Percent by Weight |
|---|---|
| Sodium molybdate | 59 |
| Sodium nitrite | 25 |
| Benzotriazole | 8 |
| Dicyclohexylammonium nitrate | 8. |

The resin and corrosion inhibitor solids were blended together, extruded, and pelletized to form a master batch component.

Twelve pounds of the master batch was blended with 88 pounds of ionomer resin ("Surlyn 1601-2") and the blended formulation extruded into a film. This resulting film is utilized as the skin film package material. Similarly, films suitable for blister film packaging are prepared with a ratio of about 2% of vapor corrosion inhibitors in the final film.

EXAMPLE II

A heat activated film forming adhesive is selected, with the adhesive being preferably a water emulsion of ethylene vinyl acetate. One such material which is commercially available and which has been found useful is available under the trade designation "Latiseal B7089AN". Another adhesive found useful is available under the trade designation "Latiseal A7734A". Both adhesives are available from Pierce & Stevens Company of Buffalo, N.Y.

The water emulsion adhesive is blended with a mixture of the same chemicals as used in Example I at a ratio of about 2% based on the film solids. The emulsion is suitable for coating on the substrate boards used for either skin or blister film packages at a level of 3 to 5 pounds per ream.

Testing the Invention

TEST I

Steel and copper panels (3"×5") were placed onto an untreated substrate board and sealed in the film prepared in accordance with Example I. When subjected to an atmosphere of $SO_2$ for 24 hours, which is an accelerated corrosion test, the panels showed very little corrosion. Control panels, which were sealed with a film to which the corrosion inhibitor had not been added, showed severe corrosion when subjected to the same $SO_2$ corrosion test.

TEST II

Steel and copper panels (3"×5") were sealed with the film prepared in Example I and mounted on the substrate board prepared in accordance with Example II. These panels showed no corrosion when subjected to the atmosphere of $SO_2$ for a period of 24 hours, which is a severe accelerated corrosion test.

TEST III

The test substrate board prepared in Example II was used with both treated and untreated film to prepare samples for testing, and the steel and copper panels showed no corrosion when enclosed in the treated film and treated board and exposed to an atmosphere of sulfur dioxide ($SO_2$) for a period of 24 hours. The steel and copper test panels exhibited only little corrosion when the treated board was used with untreated film. In this example, the treated film is that prepared in accordance with Example I, while untreated film is film prepared from Surlyn resin to which no vapor phase corrosion inhibitor has been added.

EXAMPLE III

A quantity of PVC resin was blended with 3% by weight of a vapor phase corrosion inhibitor consisting of:

| Component | Percent by Weight |
|---|---|
| Cyclohexylammonium p-nitro benzoate | 15 |
| Sodium nitrite | 50 |
| Benzotriazole | 10 |
| Cyclohexylamine benzoate | 25. |

This resin was then formed in a blister configuration of a flanged open bottom parallelepipedon.

Substrates suitable for blister packaging are prepared with the same resins and inhibitors as described in Example I.

Test panels of steel and copper were sealed in the blister pack and exposed to an atmosphere of $SO_2$ for a period of 24 hours, with the atmosphere being air to which 1% to 3% of $SO_2$ had been added. No corrosion was evident.

The preferred formula for maximum steel protection in the accelerated $SO_2$ test is the one described in the above examples. For protecting other metals such as copper, aluminum, or the combinations of metals used in the electronic or medical products industries, films and coated substrate boards could be prepared with the following ratios of chemicals:

| Component | Percent by Weight |
|---|---|
| Alkali molybdate | 50–70 |
| Alkali nitrites | 21–30 |
| Triazoles | 6–10 |
| Amine salts | 6–10. |

The Steps in the Skin Packaging Process

The detailed operations of the skin packaging process of the present invention will be described with reference to the drawing figures. Specifically, in the figures, the system for conducting the packaging process is illustrated at 10, with the system comprising a platform support 11 arranged to receive a substrate 12 thereon, with the substrate having a plurality of objects such as at 13—13 being disposed thereon. Superimposed over platform 11 and substrate 12 is a supply roll 15 of skin packaging film, with the film being retained or otherwise held within film clamping platen frame 16. Film portion 17, as indicated, is captured within and retained by platen frame 16. A source of thermal energy is provided by heater 18, with heater 18 being arranged in proximity to the plane of upper limit of travel of film clamping platen frame 16.

Figure 1:
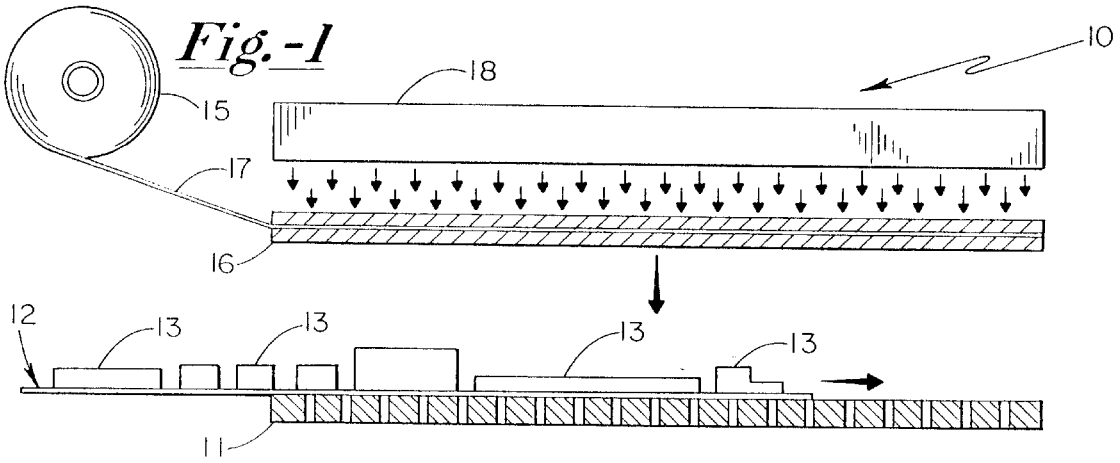
FIG. 1 is a diagrammatic elevational view of a typical first step in the skin packaging process of the present invention.
Figure 2:
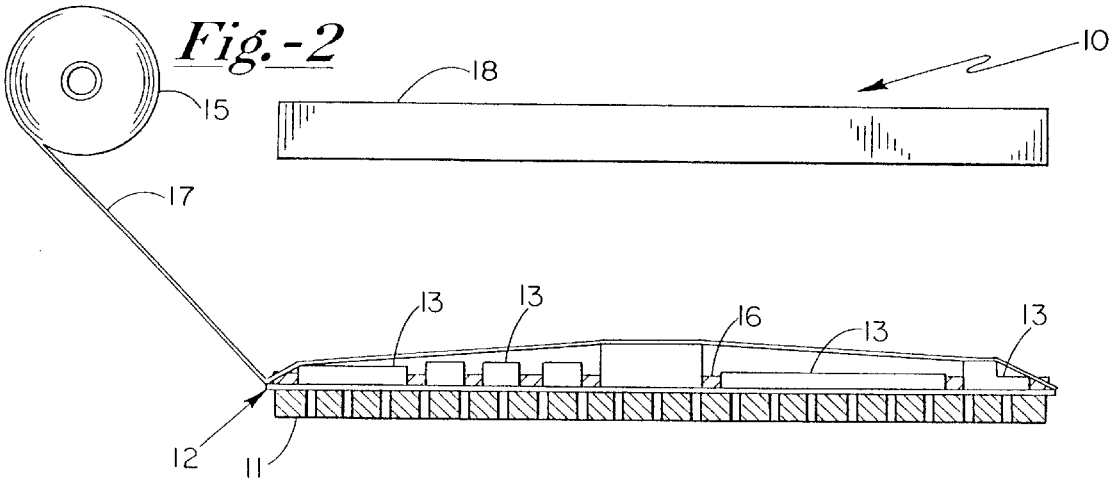
FIG. 2 is a diagrammatic elevational view of a further step in the skin packaging process of the present invention.

As illustrated in FIG. 2, film clamping platen frame 16 has been moved downwardly so as to bring the heated film forming the packaging skin into contact with the surface of substrate 12, and also enveloping the objects 13—13 being packaged. As illustrated in FIG. 2, film segment or portion 17 is in the form of a precursory package.

Figure 3:
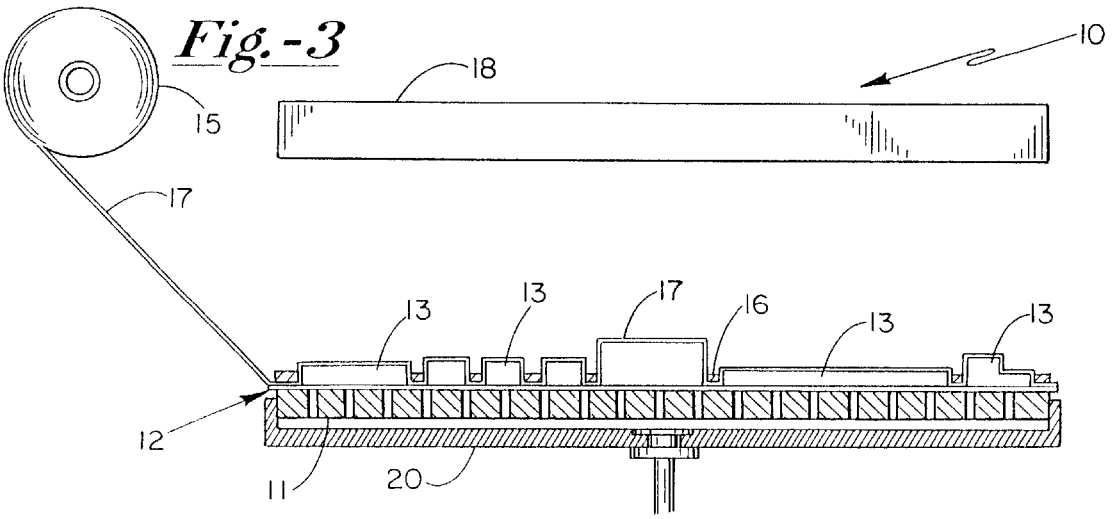
FIG. 3 is a diagrammatic elevational view of a still further step in the skin packaging process of the present invention.

With attention now being directed to FIG. 3, a vacuum system having an evacuated platform enveloping enclosure pad 20 is utilized to draw the film tightly around the product, and also bringing the skin packaging film into contact with the adhesive coating on the substrate. As is apparent in the drawings, platform 11 is perforated in order to accomplish appropriate transmission of the evacuated zone created.

Figure 4:
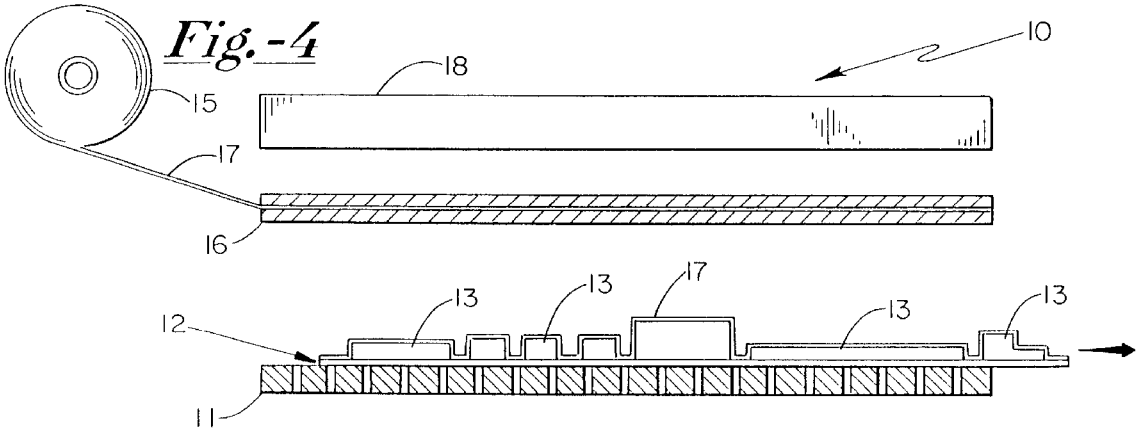
FIG. 4 is a diagrammatic elevational view of a typical final step in the skin packaging process of the present invention.

With attention being directed to FIG. 4, it will be seen that the finished package is being moved off of platform 11 for ultimate discharge from the system. Suitable cutting means (not shown) are provided in order to sever film from the supply roll 15 and render the film ready for engagement in film clamping platen frame 16.

With attention being directed to FIGS. 5 through 10 of the drawings, FIG. 5 illustrates the nest mold 22, with FIG. 6 illustrating the nest mold 20 into which blister 23 has been inserted. FIG. 7 shows a metal part 24 having been dropped into the open blister. In FIG. 8, board 25 which has been coated with a blend of water-based adhesive containing about 1 ounce of corrosion inhibitor per gallon of adhesive on the surface contacting the blister pack is advanced into contact with the flanges 26 of the blister pack. FIG. 9 illustrates schematically the application of heat, with the finished blister pack being illustrated in FIG. 10.

The Blister Packaging Operation

In addition to use in skin film-type packaging, the present invention is adaptable for use in blister packaging as well. Blister packaging typically employs "blister" structures which are typically fabricated of polyvinylchloride (PVC) resin, although for some purposes, blisters are fabricated of cellulose acetate butyrate (CAB) and other conformable resins. For purposes of the present invention, the blisters are fabricated with resin to which a quantity of vapor phase corrosion inhibitor has been added, typically between 2% and 4% based on total weight of resin solids. The substrate boards are typically coated with water-based adhesive, with these primers being, of course, commercially available. In accordance with the present invention, the primers are blended with a quantity of vapor phase corrosion inhibitor,-typically between 20 grams and 30 grams per gallon of primer liquid. Two commercially available primers used on blister board carry the designations "B7440A" and "B7039A", and are available from Pierce & Stevens Company of Buffalo, N.Y.

It will be appreciated, of course, that the specific embodiment described and disclosed herein is given for purposes of illustration only and the details are not to be construed as a limitation upon the reasonable scope of the appended claims.

What is claimed is:

1. In the method of enclosing and protecting the surfaces of a metallic object against corrosion through utilization of a vapor phase corrosion inhibitor while the metallic object is confined within a skin packaging envelope, the steps comprising:

(a) preparing a suitable substrate board;

(b) selecting a thermally activated adhesive and preparing a mixture of said adhesive with a vapor phase corrosion inhibitor wherein the vapor phase corrosion inhibitor is selected from the group consisting of alkali molybdates, alkali nitrites, triazoles, and amine salts;

(c) selecting a thermal-forming resin film comprising a copolymer of ethylene and a vinyl monomer having an acid group thereon and with said ionomer film being compatible with said thermally activated adhesive;

(d) blending a vapor phase corrosion inhibitor selected from the group consisting of blends of alkali molybdates, alkali nitrites, triazoles, and amine salts with said thermal forming resin film having an acid group thereon to form a skin packaging film;

(e) applying a film of said thermally activated adhesive mixture onto the surface of said substrate along at least certain predetermined areas thereof;

(f) positioning said substrate in a sealing station with the metallic object to be protected being disposed on the surface thereof, and with said skin packaging film comprising said resin film being superimposed over said substrate;

(g) heating said skin packaging film to its formable temperature;

(h) positioning said skin packaging film onto the surface of said substrate with predetermined areas of said film being in face-to-face contact with said thermally activated adhesive layer while at said formable temperature, and forming a precursory enclosure about said metallic object to be protected; and (i) immediately evacuating said precursory enclosure to simultaneously draw said skin packaging film about the periphery of the metallic objects to be protected and causing sublimation of said corrosion inhibitor while bonding and sealing the film surface to said thermally activated adhesive layer.

2. In the method of enclosing and protecting the surfaces of a metallic object against corrosion through utilization of a vapor phase corrosion inhibitor while the metallic object is confined within a blister packaging envelope, the steps comprising:

(a) preparing a suitable substrate board;

(b) selecting a thermally activated adhesive and preparing a mixture of said adhesive with a vapor phase corrosion inhibitor wherein the vapor phase corrosion inhibitor is selected from the group consisting of alkali molybdates, alkali nitrites, triazoles, and amine salts;

(c) selecting an envelope fabricated from a resin film such as polyvinylchloride and cellulose acetate butyrate, with said film being compatible with said thermally activated adhesive;

(d) blending a vapor phase corrosion inhibitor selected from the group consisting of blends of alkali molybdates, alkali nitrites, triazoles, and amine salts, with said thermal forming resin film to form a blister packaging film;

(e) applying a film of said thermally activated adhesive mixture onto the surface of said substrate along at least certain predetermined areas thereof;

(f) positioning said substrate in a sealing station with the metallic object to the protected being disposed on the surface thereof, and with said blister packaging film comprising said resin film being superimposed over said substrate; and (g) positioning said blister packaging film onto the surface of said substrate with predetermined areas of said film being in face-to-face contact with said thermally activated adhesive layer and forming a precursory enclosure about said metallic object to be protected.

* * * * *